US008434277B2

(12) United States Patent
Paolucci

(10) Patent No.: US 8,434,277 B2
(45) Date of Patent: May 7, 2013

(54) DEMOUNTABLE MODULAR STRUCTURE FOR HIGH-EFFICIENCY RAISED DECK PARKING LOTS WITH HERRINGBONE PARKING STALLS

(76) Inventor: Stefano Paolucci, Rome (IT)

( * ) Notice: Subject to any disclaimer, the term of this patent is extended or adjusted under 35 U.S.C. 154(b) by 1138 days.

(21) Appl. No.: 11/640,173

(22) Filed: Dec. 18, 2006

(65) Prior Publication Data

US 2008/0120925 A1 May 29, 2008

(30) Foreign Application Priority Data

Nov. 29, 2006 (IT) ..... RM2006A0634

(51) Int. Cl.
*E04H 6/42* (2006.01)
*E01F 9/00* (2006.01)

(52) U.S. Cl.
USPC ..... 52/174; 52/177

(58) Field of Classification Search ..... 52/174, 52/175, 177, 126.6
See application file for complete search history.

(56) References Cited

U.S. PATENT DOCUMENTS

| | | | | |
|---|---|---|---|---|
| 3,136,092 | A * | 6/1964 | Contini | 52/73 |
| 3,570,687 | A * | 3/1971 | Toedtli | 414/239 |
| 5,025,598 | A * | 6/1991 | Manna et al. | 52/126.6 |
| 5,720,135 | A * | 2/1998 | Paquette | 52/174 |
| 6,016,634 | A * | 1/2000 | Sayer | 52/648.1 |

FOREIGN PATENT DOCUMENTS

| | | | |
|---|---|---|---|
| EP | 0 364 414 | | 4/1990 |
| EP | 1736616 | A1 * | 12/2006 |
| EP | 2093352 | A1 * | 8/2009 |
| JP | 01203540 | A * | 8/1989 |
| JP | 5-156833 | | 6/1993 |
| JP | 06136980 | A * | 5/1994 |
| WO | 2007/088573 | | 8/2007 |

OTHER PUBLICATIONS

Written Opinion and Search Report of the International Searching Authority, dated Jun. 16, 2008 and issued in related International Patent Application No. PCT/IT2007/000759.

* cited by examiner

*Primary Examiner* — Joshua J Michener
*Assistant Examiner* — Elizabeth A Plummer
(74) *Attorney, Agent, or Firm* — Young & Thompson

(57) ABSTRACT

Demountable modular structure for the construction of one-deck raised parking lots, preferably without foundations, designed to be employed for parking vehicles in angled arrangement, or herringbone pattern, including two or more parallel structure strips, each one defined by two rows of pillars offset from each other in the longitudinal direction of the structure strip so as to form, between two adjacent couples of pillars, parallelogram-shaped portions of ground surface, wherein the upper level is made of an orthogonal network of main beams resting on each one of the rows of pillars and secondary beams resting on the pillars or fixed in orthogonal position to the main beams, and of rectangular or square floor slabs. The structure allows easier parking and maneuvering of larger vehicles as compared with structures with 90-degree parking stalls, with no detectable losses of efficiency in terms of parking places obtainable from a given available surface.

20 Claims, 7 Drawing Sheets

DEMOUNTABLE MODULAR STRUCTURE FOR HIGH-EFFICIENCY RAISED DECK PARKING LOTS WITH HERRINGBONE PARKING STALLS

BACKGROUND OF THE INVENTION

The present invention relates to a demountable modular structure for high-efficiency raised deck parking lots with herringbone parking stalls.

More particularly, this invention relates to a structure of the same kind as the structures commercially known for the construction of one-deck raised parking lots, preferably without foundations, designed to be employed for parking vehicles in angled arrangement, so that vehicles of larger size than standard can maneuver and park with more smoothness compared to the parking lots having 90-degree parking stalls, and also with no detectable loss of efficiency in terms of parking places obtained with the same available parking surface.

DESCRIPTION OF THE RELATED ART

As it is known, constructions of one raised floor or deck that can be set up in short time and with restricted economic resources are the object of a particular interest, particularly for building more or less temporary parking lots, as an alternative to conventional multistory underground and/or raised car park constructions. Although the latter represent, apparently, the most obvious solution to the problem of the lack of areas for car parking purposes, especially in densely populated zones or in zones with high vehicles influx, as in proximity of an airport, a railway station, a stadium, a hospital or an industrial building, quite often they cannot be adopted because of practical difficulties, or for the impossibility of using the building ground indefinitely, or for economic drawbacks due to the costs of the realization, or also because the requested time periods for building are not compatible with the utilization needs. In such a situation, the possibility of obtaining rapidly and at low costs additional raised parking places on already existing surface parking areas, or else on areas that cannot themselves be employed as parking lots, e.g. owing to archaeological or environmental restraints, is certainly advantageous, and has been so far exploited through the realization of single-deck modular structures, preferably without foundations and, even more preferably, demountable and re-usable structures.

A structure of this kind that has had the widest diffusion in Europe is the structure disclosed in the European patent EP 0364414 (in the name of Centro Progettazioni Coordinate s.r.l., i.e. the Fast Park®), the description of which is incorporated herein by reference. Such structure consists of a modular and sectional assembly that can be easily installed for setting up, in extremely short times, a raised deck to be used as a parking place for cars, and that can be also disassembled and recovered for reutilization, for instance in a different location. The structure substantially consists of modular units each of which comprises a rectangular or square composite floor element, surrounded by four edge beams and held up at its corners by four vertical supporting elements or pillars that bear said edge beams through corresponding node elements or capitals. Under the said vertical supporting elements, special bases for resting on the ground are provided, while a system of ties and/or struts transversely strengthens the structure. A schematic view of the modular structure is shown in FIG. 1 of the attached drawings, which corresponds to FIG. 1 of EP 0364414, wherein with (1) the modular units are shown as a whole and with (2) the ramps for entering the upper level are shown.

As is shown in FIG. 2, also taken from the European patent at issue, each vertical supporting element (3) —column or pillar—comprises, towards its base (4), a threaded pivot (5) that has the function of allowing the regulation in length of the said vertical element. The base (4) also comprises, above the foot (6) made by a flat plate, a hinge system (7), in particular consisting of a spherical joint (not visible), that allows the foot (6) to lay on the ground according to the slope of the existing surface, while allowing the above supporting element (3) over it to assume a perfectly vertical position. Such a double adjustment system makes it possible to install the modular structure even over not previously leveled, uneven grounds, and without any need to provide for foundation works. The structure according to the European patent EP 0364414 is set up by assembling the modular units beside one another, with adjacent modules sharing in turn the relevant beams and supporting elements, so as to conform the raised deck for the car parking that assumes the desired shape and size.

In the structure described above there can be distinguished a composite basic module consisting of a raised deck portion with the corresponding supporting structure, determined by four edge beams and by four columns or pillars at the four angles of said raised deck portion. It is evident that the structure, in addition to the raised deck for parking, for moving and sorting the vehicles to the parking stalls, also comprises at least one ramp for entrance and/or exit (shown by numeral 2 in FIG. 1), connecting the raised deck with the ground floor.

In the simplest configuration, the distribution of the car spaces under the modules appears to be as shown in FIG. 1: in a strip having a threemodule width, the central module is the drive aisle for the cars and the two modules right and left of the drive aisle are employed as parking stalls, by entering each car place with a 90° maneuver.

As it results from the foregoing, a typical feature of these structures is the strong correlation between the modularity of the beams-columns supporting system and the modularity of the floor system. Consequently, the quadrangular modular scansion of the supporting structure exactly corresponds to the quadrangular scansion of the deck elements of the upper level.

As disclosed by EP 0364414, the most convenient measures for the basic module are those corresponding to two parallel parking spaces, that, at least in Europe, are preferably of 5×5 m; a similar module of 5×5 m defines an element of the traffic lane, sufficient to be an aisle with a double way of transit, but preferably utilized, in the public parking lots, as a one-way driveway. The choice of a square mesh on one hand and, on the other hand, the identity between the modules for the parking and those for the maneuvering, produce a simplification in the overall production and realization process that turned out to be highly advantageous from both technical and architectural point of view and from the economic point of view, once the structural components are made standard and uniform.

As noted above, among the features of the modular parking structure according to EP 0364414, the feature to which the major success of this type of structure is due to the fact that this structure does not need traditional foundations, i.e. the structure is leaned over the existing asphalted pavement with no need to prepare the setting surface for the installation. All the arrangements necessary for its stability, even in the case of a seismic event, are reduced to fixation works into the ground using nailing or screw-bolts, and to the installation of a sufficient number of horizontal and vertical bracing elements, able to connect in a suitable way the structural nodes of the system. More particularly, as concerns the bracing elements to be placed in the vertical planes (8 and 9 in FIG. 2), the supporting bases are connected both with each other and with the capitals of the adjacent column by ties or struts, while the horizontal bracing elements (10 in FIG. 2) co-operate in connecting the diagonally opposed capitals with each other.

Whilst the horizontal bracing, that is located at the capitals level, does not obstruct the free circulation of the cars under the modular structure, the vertical bracing has to be articulated and organized in such a way that it does not obstruct the maneuvering of the vehicles. The preferred and also the technically most efficient position of the ties and struts is a type of distribution that, seen in plan, represents a "star shape": four couples of ties/struts in the vertical planes converge on the same column (base and capital) so that, in plan, a cross is formed, and from the same capital also the network of the horizontal bracing starts, each brace directed towards the capital diagonally opposed in the module. In this way the traction tensions, to which the bracing has to resist, may find a common distribution point in the node (capital) at the top of the column that is in the centre of the "star".

The higher the complexity degree of the parking lot plan, the taller the raised deck and the higher the seismic level of the installation site is, the more articulated and complex the bracing system shall be.

In a parking structure similar to the one described in EP 0364414, the absence of any foundations under the columns also generates, besides the mentioned stability problems (which are solved by the bracing system), the problem of the load-bearing capacity of the ground of the setting. The square module measuring 5×5 m produces, on the ground under a single column, a load that is proportional to the raised surface incident over said column. This surface corresponds to the size of four fourths of a standard module. On the other hand, it is the ratio between the load transmitted through the column and the support surface over the setting ground that defines, in terms of pressure, the entity of the load transmitted on the ground by the structure without the intermediate of foundation elements or plinths. This ratio grows in a quadratic way with the module size: an increase by as low as 10% of the module side length is able to produce an increase of over the 20% of the load transmitted to the ground. This fact considerably restricts the possibility to increase the module size.

As noted, the bracing system, that is imposed in the structures without foundations, is able on one hand to guarantee the modular structure stability but, on the other hand, is also an obstruction to the free circulation and the parking maneuvering of the vehicles at the lower level. Therefore, the modular structures described before have been employed to date for the setting up of new raised decks where the vehicles are parked with no restriction on the upper level, while on the ground level only the 90-degree parking is permitted, that is parking turning by 90° from the traffic aisle.

As a matter of fact, the module, that is square or rectangular, allows on the ground floor an efficient parking of vehicles (in terms of exploitation of the surface) only in a perpendicular direction from the traffic aisle. However, the bracing elements in the vertical planes connecting the column bases with the capitals of the adjacent columns run in a way that is in conformity with the module, using planes that are necessarily perpendicular to the aisle, or planes parallel to the same aisle, i.e. parallel or perpendicular to the parked car. Consequently, the bracing planes necessarily mark the limits of 90-degree parking stalls.

According to what currently proposed by normal architectural technique as concerns the design of parking surfaces, a parking stall for vehicles has a size comprised in the rather narrow range of from about 4.8 m to about 5.0 m in length and from about 2.30 m to about 2.50 m in width. The design composition of the parking spaces can be carried out substantially in three ways: 90-degree parking spaces, angular parking spaces or "herringbone" parking spaces, having any turning angle lower than 90°, preferably 45° and 60°, and parking spaces parallel to the traffic aisle.

The choice between these various combinations of patterns depends on a number of issues, among which, for example, the size of the parking surface, its shape, the user-friendly degree required of the parking facilities, the kind of users of the parking lot and the stay duration. For example, the 90-degree parking is generally the most efficient type in the event that one of the sides of the parking area is long 15-15.5 m or his multiples, i.e. two lines of 90-degree spaces with one drive aisle in the middle. The pattern with spaces parallel to the aisle is mainly used for on street parking, whilst the herringbone parking, although not always being the best one in terms of efficiency, results to be the most agreeable to the users, because of the ease of the turning maneuver, and in any case it is the most suitable for the parking of bigger vehicles.

More particularly, describing the herringbone type of parking, a geometrical feature of this parking type is that the longitudinal portion of the drive aisle used by a parking stall is greater than the width of the same parking stall. More precisely, if the stall is a 90-degree one, the length of the aisle portion used by the same stall is exactly equal to the width of the space; if the stall has an angled position a difference exists between the two dimensions, which increases with the decreasing of the parking turning angle. In other words, once the space width is fixed, based on the standard sizes of the vehicles (between 2.35 m and 2.50 m), as the turning angle decreases the length of the drive aisle portion taken by one parking stall increases. At the borderline limit the space with an angle of 0-degree, i.e. the space parallel to aisle, uses a traffic aisle portion equal to the length of the space itself. Based on this consideration, for example, the 45-degree stall, once fixed its standard width in 2.5 m, covers a longitudinal portion of the drive aisle of about 3.6 m, i.e., almost 40% more than its width. In general, therefore, as the turning parking angle decreases also the global efficiency of the whole parking area in terms of car spaces decreases, although in favor of a better maneuverability and easier access to the parking space.

As already noted, the square modularity of the known parking systems such as Fast Park®, on one hand simplifies a number of production and construction problems but, on the other hand, makes the possibility to arrange modules of different shape from the standard less flexible, also in case of very slight changes, because of the increase in costs and in complication during the installation phase. However, the ever increasing spread of vehicles exceeding the standard measures of the usual cars (i.e. station wagons, SUV, four-wheel drive), showing sizes so big to complicate the use of the parking facility at ground level, would suggest to reconsider the stall and/or module size in favor of smoother turning maneuvers.

Nevertheless, a simple dimensional increase, for example, of the width of the traffic aisle, or of the side of the standard module, apart from the already described negative effect due to the excess of concentrated load on the ground, also brings about a reduction of the efficiency of the whole assembly, with reference to the number of car spaces available on a certain parking surface. As a matter of fact, if it is considered that this kind of structure with one only level should be able to double, or almost double, the number of car spaces existing on ground, the dimensional increase of the parking stalls, and consequently the increase of the standard module size, provokes an excessive loss of car spaces on ground with respect to the number of spaces existing before the structure installation. For example, increasing by only 50 cm the standard module in the sole direction parallel to the aisle results in a 10% loss of the ground floor spaces. Also, a drive aisle width increase of only 80 cm can result, especially in the bigger structures, in a general growth of the parking lot such as to lead to elimination of one of the existing space lines on ground.

SUMMARY OF THE INVENTION

In view of the foregoing, it is an object of the present invention to provide a construction solution for a demountable modular parking lot similar to the ones mentioned above, that may enable angled parking spaces (herringbone parking spaces) at the ground level with little or no efficiency loss as concerns the number of obtainable stalls, despite the necessary presence of bracing elements in the vertical planes between adjacent columns. Besides minimizing the loss of parking spaces obtainable under the structure as compared with the parking spaces of a hypothetical pre-existing parking at ground level, the proposed structure must avoid an overdimensioning of the basic module, in order to limit the load transmitted to the ground by each column.

To achieve such purpose, the present invention first of all proposes a different modularity for the structure, based on a geometrical displacement of the parking spaces at the ground level in a parallelogram shape. This layout is obtained by shifting the columns supporting the upper deck to lie at the corners of parallelograms that limit the parking stalls. Consequently, the bracings that, as noted, lie on vertical planes defined by two adjacent columns, result to be parallel to the parking space direction or to the drive aisle.

At the same time there is proposed, according to the invention, to maintain for the upper deck, and specifically for the floor of the raised deck, a modularity with an orthogonal network, that clearly simplifies the constructive process, because it enables the production of slabs, for example made of corrugated steel sheet filled by concrete, having the four angles of 90°. This allows the setting of main and secondary beams orthogonal to each other and not with angles which would be extremely difficult to obtain and control.

Therefore, the present invention specifically provides a demountable modular structure suitable for parking vehicles on two levels, on ground and on an upper level, comprising two or more parallel structure strips, each one defined by two rows of vertical supporting elements (columns or pillars) offset from each other in the longitudinal direction of the structure strip so as to form, between two adjacent couples of said vertical supporting elements, parallelogram-shaped ground surface portions, each one of said vertical supporting elements being provided with a base below it for resting on the ground and with a node element above it for connection with the upper level of said structure strip, said structure also comprising a number of ties and/or struts for bracing the structure, connected with their ends to said node elements and to said bases, wherein said upper level consists of an orthogonal network of main beams resting, through the node elements, on each one of said rows of vertical supporting elements, and of secondary beams resting, through said node elements, on said vertical supporting elements or fixed in orthogonal position to said main beams, and in rectangular or square floor slabs.

As it will be more easily appreciated with reference to the attached drawings, while the similar modular structures of the prior art present an unique modularity both for the structural supporting part, i.e. the columns and the beams, and for the floor portions, in the solution according to the present invention there is shown a dichotomy between the modularity of the flooring and the modularity of the supporting structure, opposing the angled arrangement of the parking stalls at the lower floor to the square or rectangular network of the floor of the upper deck. This fact enables the herringbone parking, that is preferred because of turning during maneauvering and for its ability to host vehicles having bigger dimensions than utility cars, and at the same time it avoids the need to provide a floor slab, for the raised deck, of the same parallelogram shape as the parking stalls at the ground floor, that would be a floor slab having acute and obtuse angles, which would be in practice quite difficult to realize.

For the purposes of the present invention, therefore, the "modular" definition, meaning something consisting of single identical and recurring elements, is meant as separately referred to the structural elements constituting the lower section and to those constituting the upper section, it being impossible to determine an autonomous "modular unit" comprising both levels.

Preferably, the proposed structure comprises three of said parallel structure strips, adjacent, of which the central one, at the ground level, is used as a drive aisle and the two lateral ones, at the ground level, are provided with angled parking stalls, arranged in a herringbone pattern. Said parallelogram-shaped ground surface portions provided between two adjacent couples of vertical supporting elements make up a couple of adjacent stalls.

According to a preferred embodiment of the subject structure, the offset between said rows of vertical supporting elements corresponding to the stalls on each side of the drive aisle is of the same length but in the opposite direction. In order to allow the parking on both sides of a drive aisle with one-way drive, the offset between the pillars must be alternatively in the two opposite senses of the base direction, on either side of the drive aisle, so that the parking maneuver is possible both on the right and on the left of the aisle.

Specifically, the rows of vertical supporting elements of said three parallel structure strips are set up so as to define, in plan, two strips of parallelogram-shaped ground surface portions angled in the same way and another strip angled in the opposite way, symmetric to the adjacent ground surface portion with respect to a longitudinal axis of said structure strips. In the event that the parking lot is composed by more groups of three of parallel strips of structure, the plan of the strips of parallelogram-shaped ground surface portions of one group will be the mirror image of the adjacent group of three stripes, so that the parking lanes can be driven through one after the other in an alternate direction while always finding the stalls angled in the correct sense for parking.

According to some specific embodiments of the structure according to the invention, each one of said bases or each one of said vertical supporting elements incorporates means for adjusting the total length of said supporting element.

Still according to some specific embodiments of the invention, said base comprises a flat base plate and a hinge system placed between said flat base plate and the vertical supporting element.

In a structure according to the invention which incorporates the preferred elements of the structure of the prior art referred to in the foregoing, namely both the adjustability in length of the vertical supporting elements and the hinged connection of the flat plates of the base of each supporting element, there are comprised, specifically, vertical supporting elements (pillars or columns) wherein the means for adjusting the length are made of a treaded joint between each one of the bases and the relevant vertical supporting element and, in addition, each one of said bases also incorporates hinge means, preferably but not exclusively spherical hinge means, in order to be able to adapt the slope of the flat base plate with respect to the resting surface on the ground.

Similarly to the demountable structures without foundations of the prior art, the proposed structure comprises, as noted, also ties and/or struts for bracing the structure. Of these, the ties and/or struts laying in vertical planes lay in planes marginal to said couples of stalls, excluding the vertical planes that limit on both sides said drive aisle.

The different geometry of the floor of the upper level, substantially consisting of right-angled two-dimensional elements, and on the bearing structure, which shows in the same level as the floor a modularity, defined by the setting of the pillars, with an angle different from 90°, are combined in such a way that a coherent structure results therefrom, not only from an architectural point of view. Through an accurate definition of the angles of the parallelogram representing the parking stall on the ground level, the structure is also endowed with a high convenience and efficiency from the practical point of view of the management of the parking lot.

The parking angle does not only define the layout of the stall but also the relevant angle of the parallelogram-shaped module and, indirectly, the structural shift of the lines of the columns, and in addition, the measure defining the position of the tie point of the secondary beam on the primary beam. As far as the tie between primary and secondary beams is concerned, a preferred position exists, which allows to maintain a constancy in the beams pitch.

Preferably, the secondary beam of each of the parallel structure strips are resting on the supporting elements, or are fixed to the main beams along the strip, with a constant pitch, equal to half the distance between vertical supporting elements adjacent in the direction of the drive aisle. According to the invention it has been found that if the secondary beams of one of said parallel strips are alternatively resting on the vertical supporting elements and fixed to the main beam at a point corresponding to half a bay on one side of the strip, and are fixed to said main beams at points corresponding alternatively to ¼ and ¾ of a bay on the other side of the strip, the offset resulting therefrom produces a parking angle in the stalls on the ground of about 75°.

In other terms, given the practical convenience of having a modular pitch for the connection with the secondary beams equal to half a module and, for the sake of symmetry, either in the middle of the main beam or at points at ¼ and ¾ of the same, it results that the ideal parking angle for the modular structure of the present invention is equal to the complementary of the angle the tangent of which is 0.25, or it is equal to the angle the cotangent of which is 4 (that is L tan $\gamma$=¼; tan $\gamma$=¼=0.25; $\gamma$ arctan 0.25=14,036°, where $\gamma$ is the complementary of the parking angle). The latter, therefore, is slightly smaller than 76°.

According to a specific embodiment of the present invention, therefore, said parallelogram-shaped ground surface portions are angled by 75°-76° with respect to the drive aisle direction. An angle of the parking stalls of about 75° allows to advantageously maintain the dimensions 5×5 m, already used for the modular scansion of the floor slabs of the higher level floor. In this case, the herringbone stalls of the preferred embodiment of the invention will be 2.45 m long (which is only slightly lower than the length, 2.50 m, obtainable from the 90-degree pattern), but the parking maneuver will be remarkably easier.

The coupling of the base strip according to the invention with others generates a plan of the parking lot having a generally zigzag pattern, which is, however, substantially inscribable within the perimeters of the existing surface areas, having a generally rectangular shape. In joining this composite structure having new modular elements to the rectangular shape of the existing available areas it is necessary to provide border modules with special measures, e.g. having a trapezoidal shape, which allow the parking of at least one vehicle under the special module.

Therefore, two lateral strips of each group of three strips of structure according to the invention, provided with parking stalls, end at the ground level with ground surface portions having triangular shape or rectangular trapezoid shape, and the parking stalls adjacent to said end ground surface portions having rectangular trapezoid shape are usable, if needed, as parking stalls for disabled people.

According to the preferred embodiments of the invention, the hinged base that confers the adaptability to the ground slope, that are also exploited in the demountable modular structure of the prior art, said means for adjusting the total length of the vertical supporting element consist of a threaded joint between each one of the bases and the corresponding vertical supporting element, and each one of said hinge means is a spherical hinge means. The latter comprises, preferably, a cylindrical collar rigidly fixed at the center of said flat base plate with its axis orthogonal to the plane of the base plate, a first hinge member in the shape of a spherical segment resting on said base plate within the cylindrical collar with its convex side upwards, a cylindrical pivot externally threaded, of a smaller diameter than said cylindrical collar and having, at its lower end, a second hinge member in the shape of a spherical segment with its concave side downwards, said lower end of the cylindrical pivot being inserted in said cylindrical collar, and an internally threaded sleeve fitting the cylindrical pivot and externally coupled with the hollow lower end of the vertical supporting element.

Similarly to the already known parking structures, the structure according to the invention comprises normally one or more access ramps, for entering the upper level. In particular, the proposed structure comprises at least one entrance ramp to the upper level and at least one exit ramp from the upper level.

BRIEF DESCRIPTION OF THE DRAWINGS

The specific features of this invention, as well as the advantages thereof and the corresponding operating modes, will be clearer with reference to some specific embodiments thereof, which are shown by way of example only in the accompanying drawings, wherein.

DESCRIPTION OF THE PREFERRED EMBODIMENTS

Figure 1:
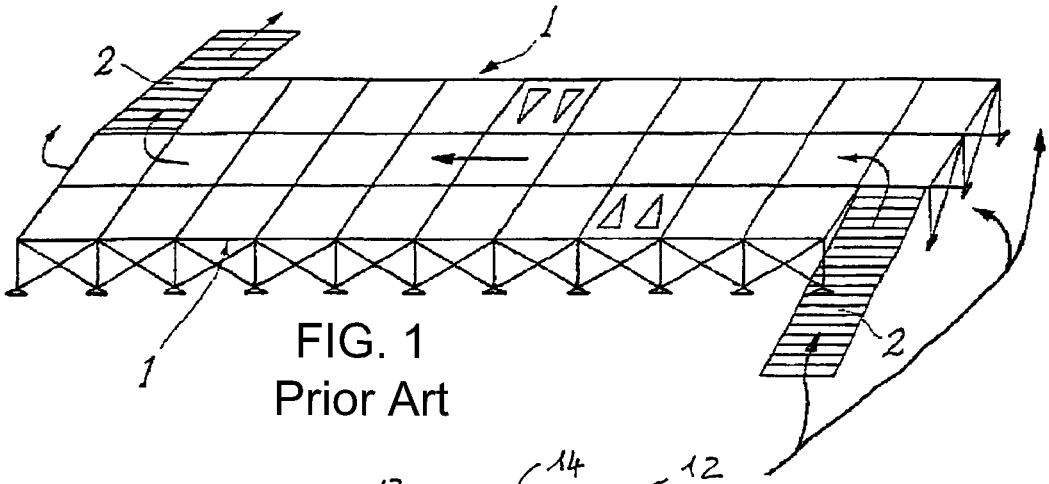
FIG. 1 Prior Art
FIG. 1 shows a schematic perspective view of a modular parking lot according to the European patent EP 0364414.
Figure 2:
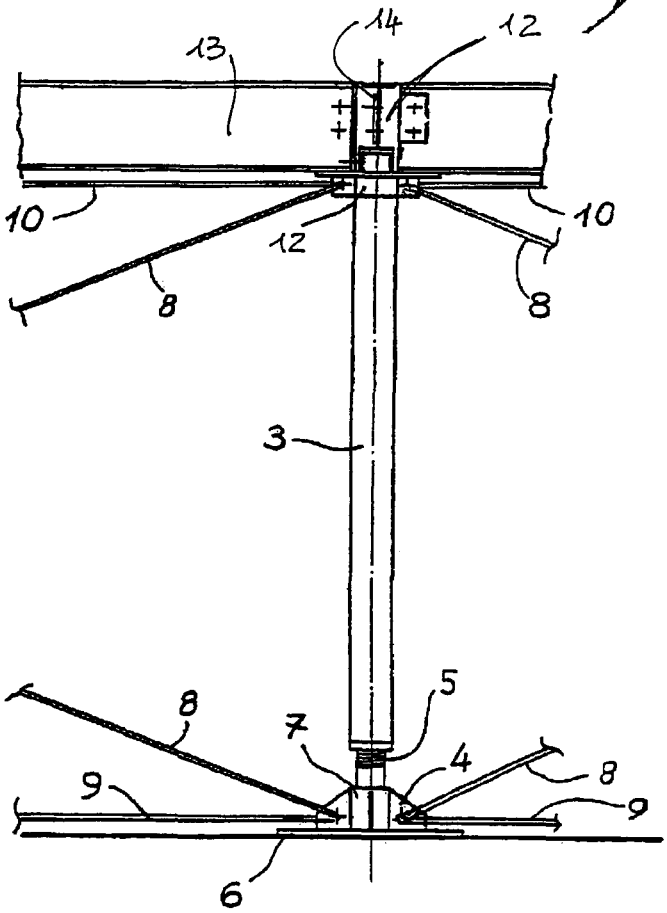
FIG. 2 Prior Art
FIG. 2 shows a side elevation view of a portion of a structure of FIG. 1.

FIGS. 1 and 2, which represent the prior art solution disclosed in the European patent EP 0364414, have already been commented upon in the introduction, where some of the elements composing the structure—modular units (1), access ramps (2), vertical supporting elements or columns (3), base (4), threaded joint (5), foot (6), hinge system (7) (not shown), bracing elements (8 and 9) in the vertical planes and bracing elements (10) in the horizontal planes—have been given reference numbers. In the same FIG. 2 there are shown the main beams (13) of the structure supporting the floor of the higher level, the node elements or capitals (12) and the section of a secondary beam (14).

Figure 3:
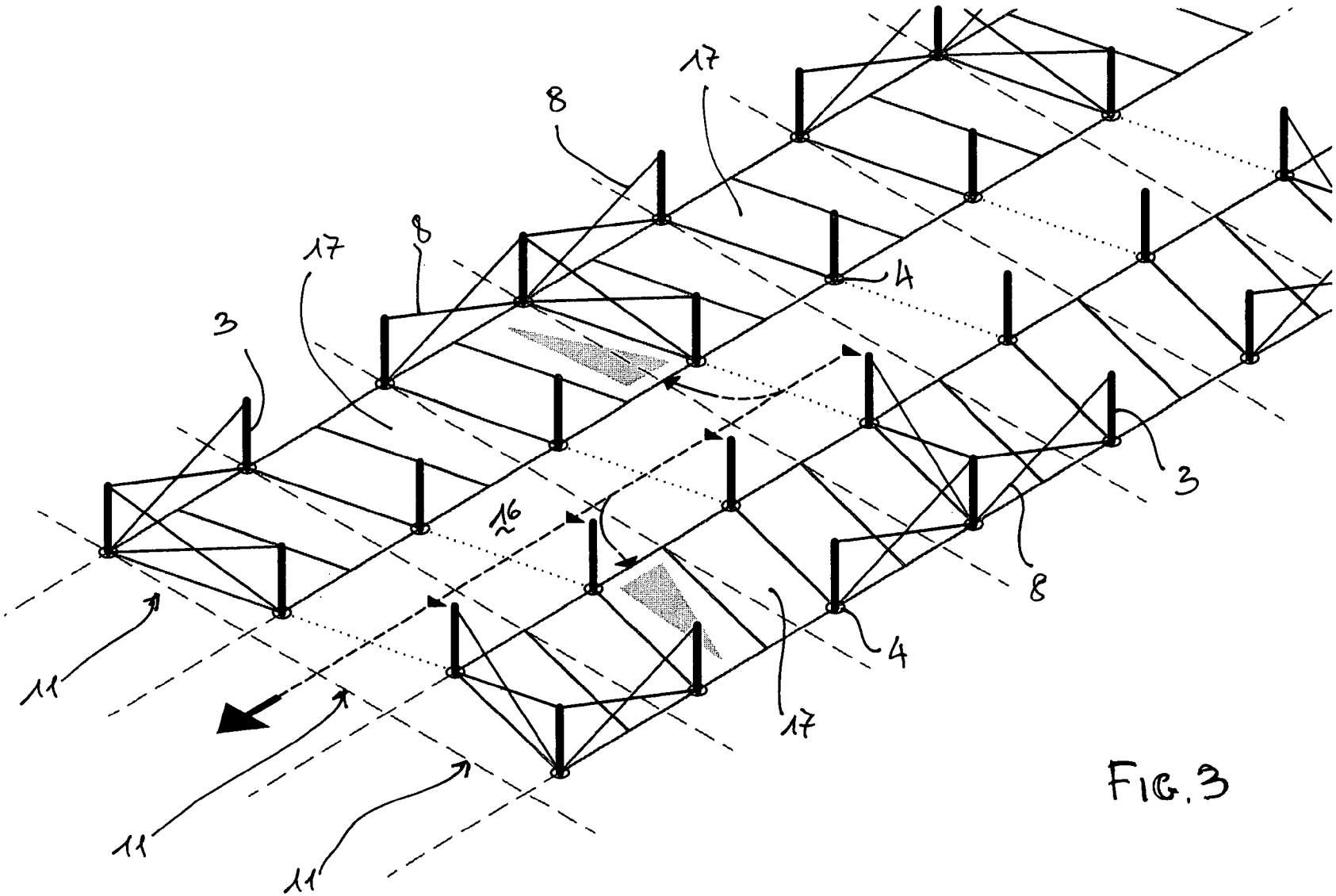
FIG. 3 is a schematic perspective view of a portion of a modular parking structure according to the invention, corresponding to three parallel strips of structure, at the lower level.

Keeping the same reference numbers, FIG. 3 shows a portion of a modular parking structure according to the invention, at the lower level, which consists of three parallel structure strips (11). The central one of these is the drive aisle (16) and the two lateral ones contain the parking stalls (17). The dotted lines show the square reference network (in the preferred case, of 5 m side) on which rows of columns (3) are set up, said columns being offset in the longitudinal direction of each structure strip (11). As it may be appreciated with reference to the square meshwork symbolically represented, the offset of the columns (3) lines is equal to ¼ of the module side, and results in an angled position of the parking stalls (17)—in a herringbone pattern—with a parking angle of about 75°. Although the module of the lower level remains of the same size as the preferred module of the prior art, the angled position of the stalls (17) makes the parking maneuver remarkably easier with respect to the 90-degree pattern, and the structure may be used without any problems for parking vehicles of bigger size than the usual compact cars, such as, for instance, four-wheels drive, SUV, station wagon, pick-ups and the like.

The parking stalls (17), two of which are shown occupied by two vehicles, symbolically represented by two triangles, are in a parallelogram shape, which, in the preferred version, corresponds to a parking angle of about 75°, and to portions of the drive aisle relevant to one stall of about 2.50 m (that is, half a module), and are about 2.45 m wide. These dimensions, coupled with a width of the drive aisle equal to about 5 m, are compatible with the parking and maneuvering of vehicles of greater size.

The bracing of the structure, which is necessary in the event that the considered parking lot is of the type without foundations, thanks to the offset of the columns (3) occupies vertical planes which do not interfere with the free maneuvering of the vehicles. Actually, the bracing elements (8) (ties and/or struts) provided in the vertical planes between a node element (14, visible in FIG. 4) and the base (4) of the adjacent column (3), and also the possible horizontal bracing elements (9) that connect two adjacent bases (4), always lay in vertical planes at the margins of the stalls (17), along the bottom line of the stall or along the angled line that divides two adjacent stalls (17).

Figure 4:
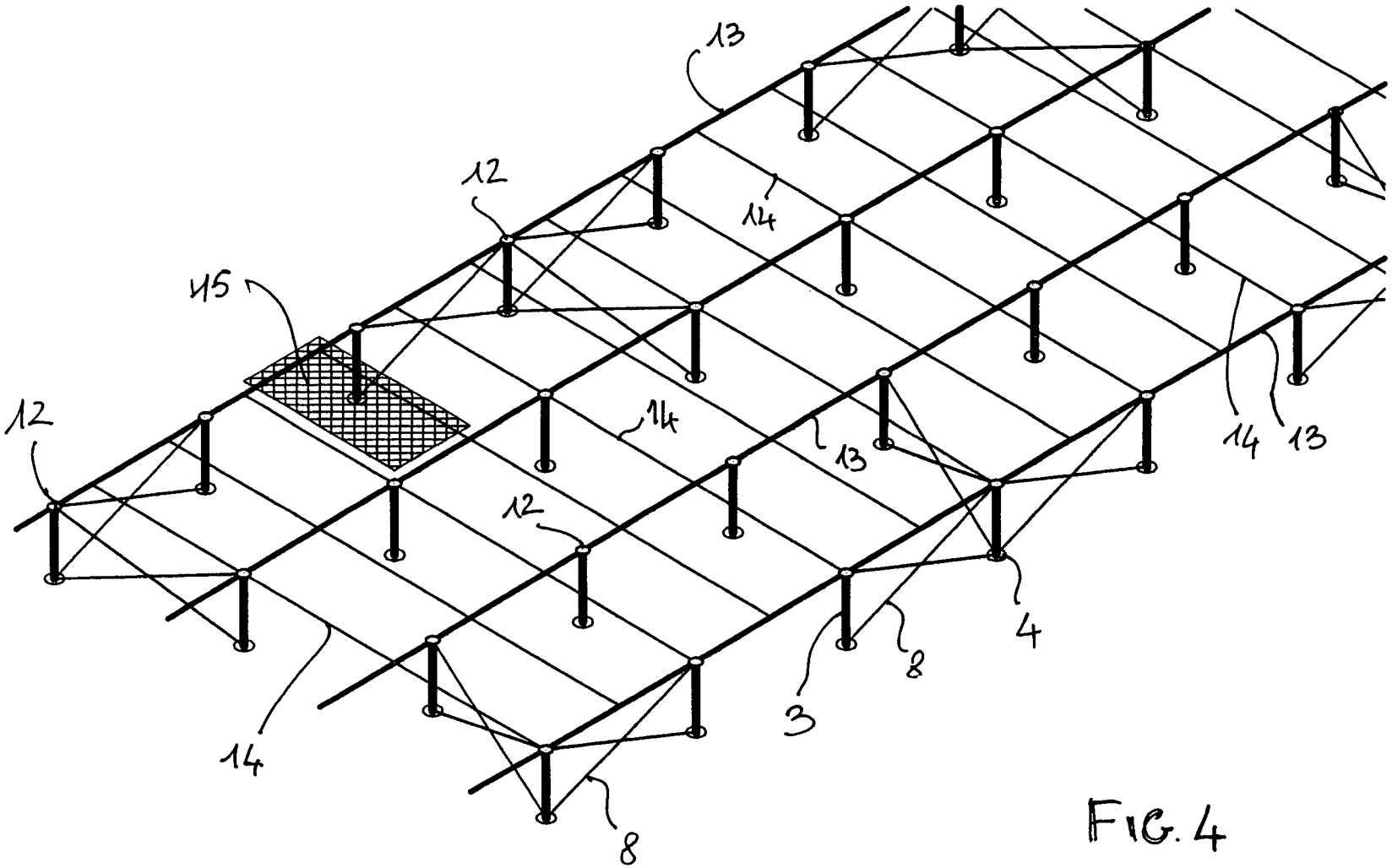
FIG. 4 is a schematic perspective view of a portion of a modular parking structure of FIG. 1 corresponding to three parallel strips of structure, at the upper level.

FIG. 4 presents the modularity of the floor at the higher level, which may be realized with independent plates (5), rectangular or square, formed, for instance, with cooperating steel sheet and concrete filling. The figure shows, for better clarity, one only floor slab (5) in an exploded graphic representation, over the position that the slab is intended to take, while the rest of the orthogonal network of the structure of main beams (13) and secondary beams (14) is devoid of the covering elements and leaves the complex of bases (4), columns (3) and bracing elements (8) of the lower level visible. In the figure it may be noted that the connection of the secondary beams (14) does not occur always in correspondence with the node elements (12) joining the main beams (13), owing the offset of the columns at the lower level. In order to maintain the orthogonality of the network of beams supporting the floor at the upper level independent of the angled pattern of the parking stalls at the lower level, the system of main beams (13) follows the direction defined as base direction and includes junction points through the node elements (12), while the secondary beams (13) are in turn either connected with a node element (12) or directly connected with a main beam (13) at a point intermediate in its bay. More precisely, in the preferred case shown here, where the columns are offset by ¼ of the module side in the longitudinal direction of the structure strips (11), the secondary beams (13) are fixed, on one side of a structure strip (11), alternatively to a node element (12) and in the middle of the main beam (13) and on the other side of the structure strip (11) alternatively at points at ¼ and ¾ of the main beam (13).

Figure 5:
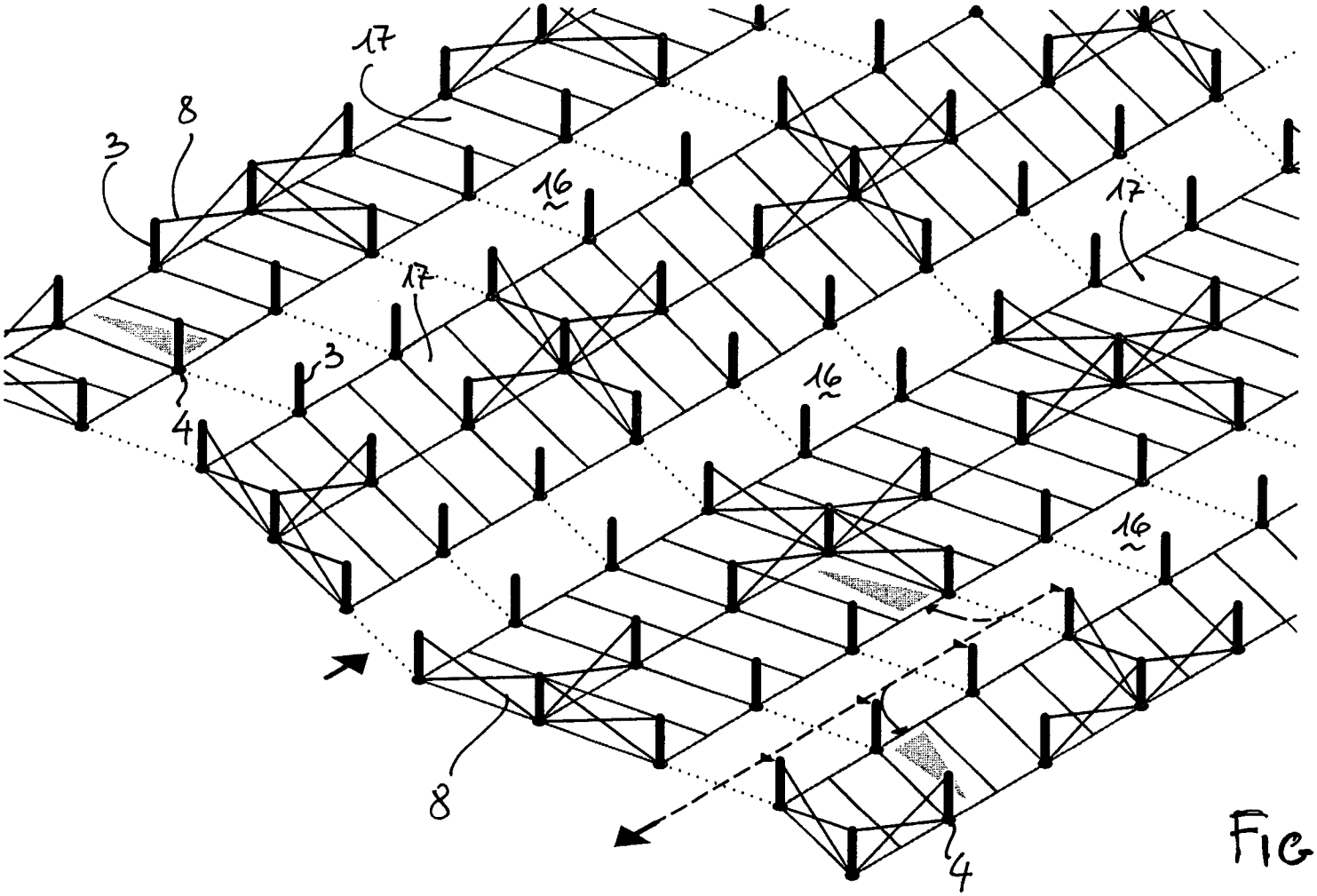
FIG. 5 is a schematic perspective view of a portion of a modular parking structure according to the invention corresponding to nine parallel strips of structure, at the lower level.

FIG. 5 shows how more strips of modular parking structure according to the invention, of the same kind as those shown—at the ground level—in FIG. 3 may be combined in order to realize a parking lot. If the portions of ground surface defined by the lines of columns (3) are placed for each group of three strips with a drive aisle (16) and two rows of herringbone parking stalls (17), angled by the same angle but in a mirror-reflected position with respect to the traffic direction, a vehicle proceeding on the drive aisle (16) in the sense shown by the arrow will find the parking maneuver clearly more smooth than the 90-degree parking. If, in addition, the groups of three structure strips (11) are combined in such a way that the rows of columns (3) have a mirrored offset with respect to the adjacent three strips (11), the drive aisles (16) of the whole parking lot can be driven through one after the other (alternatively in the opposite way) while always finding the herringbone parking stalls (17) in the correct position for the parking maneuver.

Figure 6:
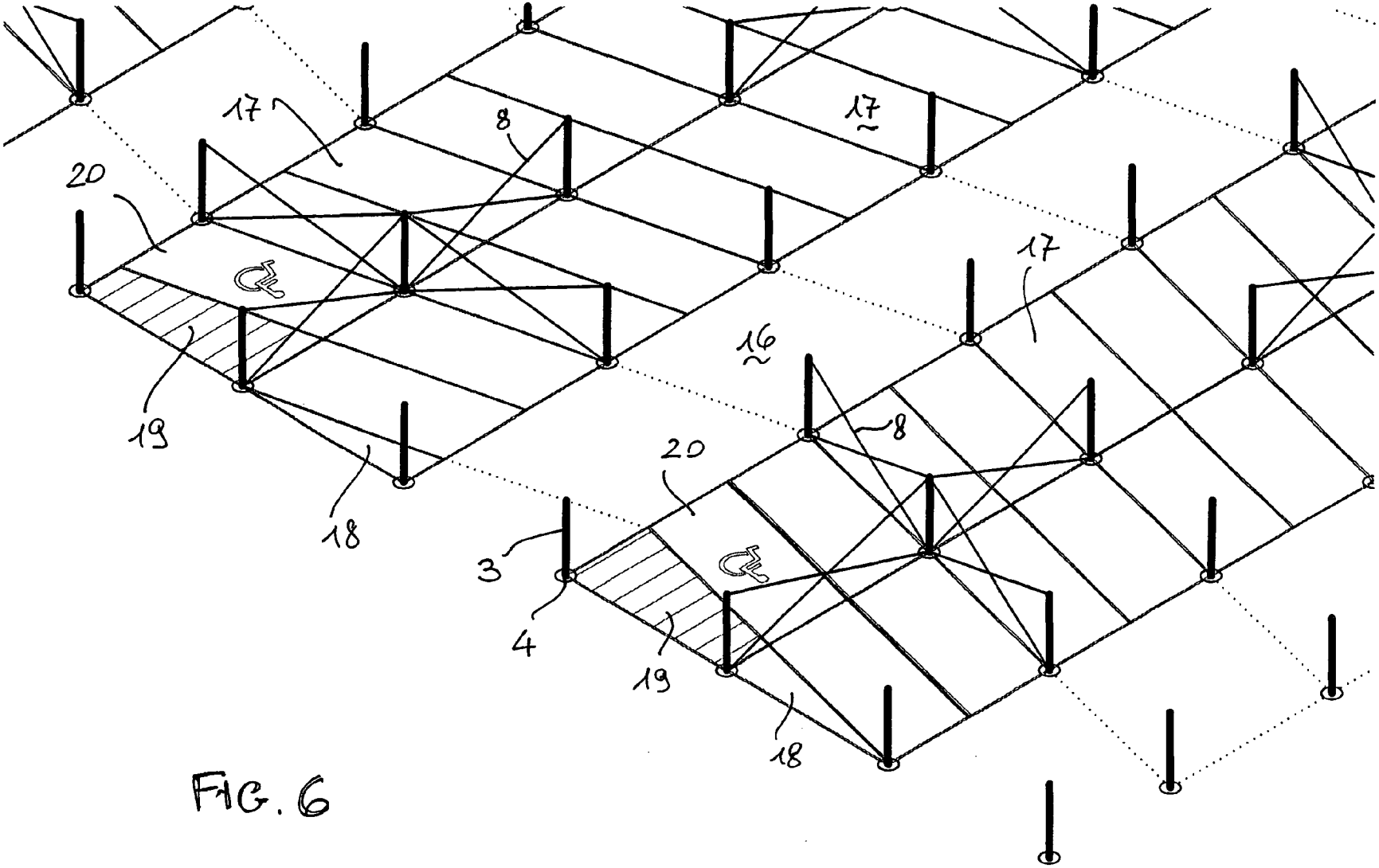
FIGS. 6 and 7 show schematic perspective views of portions of a modular parking structure according to the invention, in correspondence of the external border of the structure, respectively at the lower and upper level.

In view of the fact that the parallelogram modularity of the ground level has to be joined to the orthogonal network modularity of the upper floor, at the ground floor the end portions of each structure strip (11) will have, in the preferred embodiment of the proposed structure, the shape shown in FIG. 6: the last stalls (17) of each row are flanked by terminal surface portions which may be triangular (18) or in the shape of a rectangular trapezoid (19). The latter are particularly suitable to be exploited as parking stalls (20) for disabled people. It is evident that in such terminal position the last columns (3) do not follow the same pattern in parallelograms as the rest of the structure, and the end portions of main beams (13) are longer (in the preferred embodiment, by ¼ of module and by ¾ of module) than the main beams (13) of the remainder of the structure.

Figure 7:
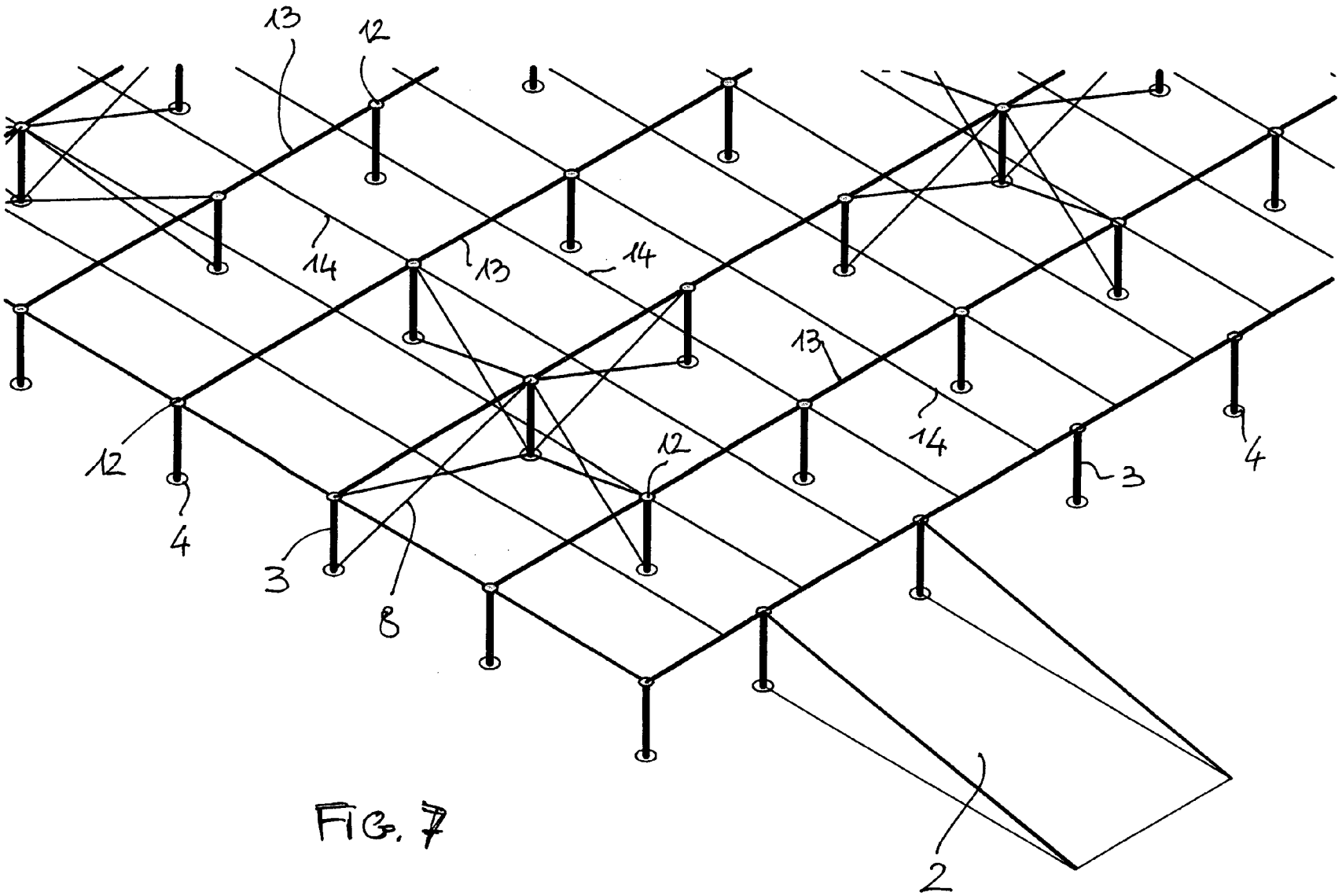

A similar solution, that does not involve any remarkable constructive complication and at the same time solves the problem of the parking places for the disabled, makes it possible to realize at the upper level, as shown in FIG. 7, a structure with the sides perfectly orthogonal, so that the available area may be exploited at best for the construction of the parking structure. FIG. 7 also o shows, schematically, the position of an access ramp (2), but it is clear that the number and the position of such ramps (that in any case are preferably two, in order to be used one-way) will vary depending on the design requirements of each case.

Figure 8:
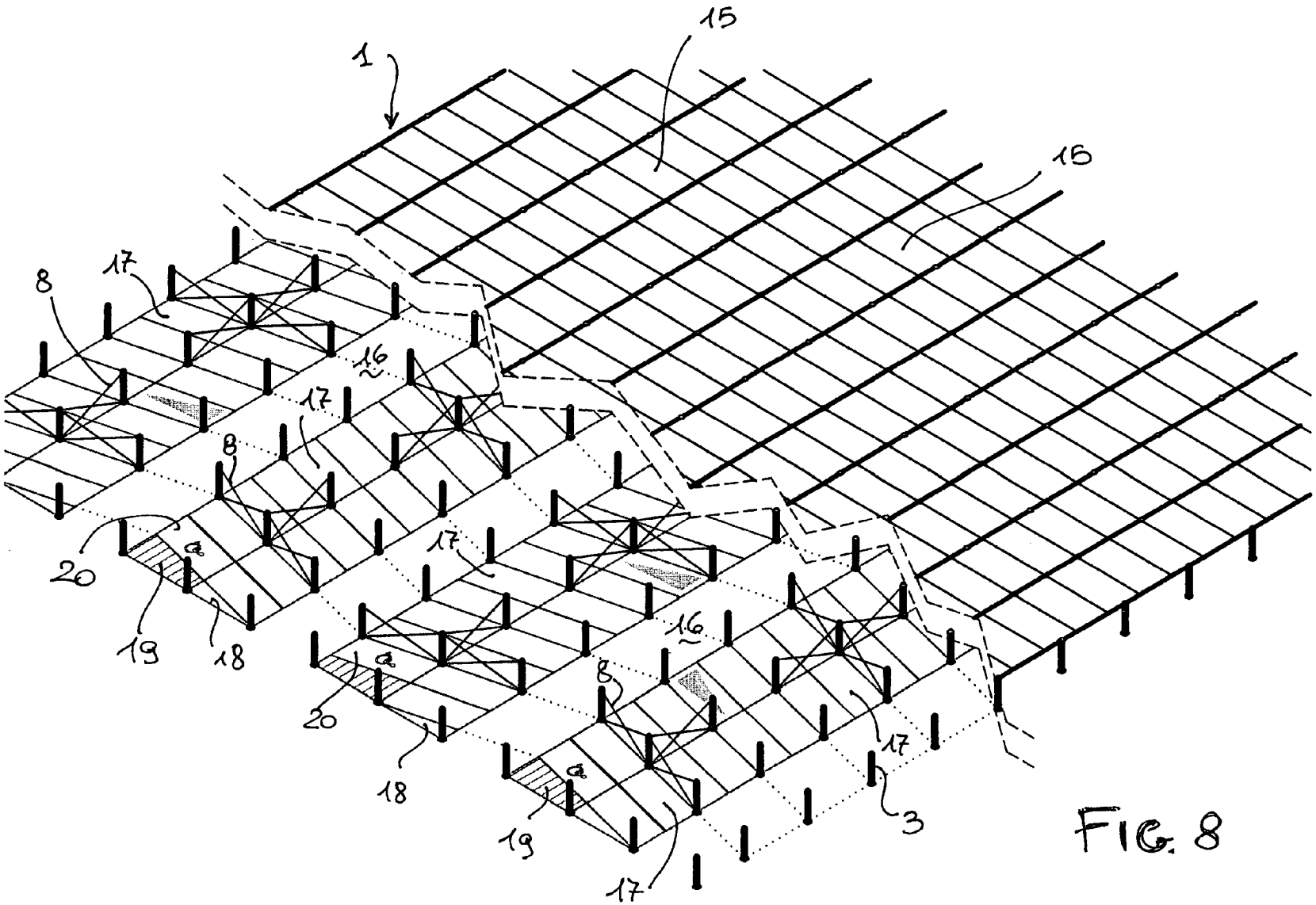
FIG. 8 shows schematic perspective view of a portion of a modular parking structure according to the invention, with both levels, and the lower level partially broken away.

FIG. 8 schematically shows an overall view of a parking structure according to the invention, with both levels but limited to a partial section, which does not include the sites where the ramps (2) are placed. The upper level of the structure is partially sectioned, to show the position of the columns (3) and of the stalls (17) at the lower level. It is evident that at the higher level, since the bracing hindrance is not present, the stalls distribution may be designed in the most various way, in accordance with the design choice of each case.

The demountable parking structure according to the invention, finally, may comprise bases (4) for resting on the ground, having a hinged foot, means for adjusting the columns length such ad threaded joints (5), node elements (12) of the same kind as those provided by EP 0364414 and schematically illustrated, for instance, in FIG. 2. Elements as pedestrian stairs, safety fences, supporting element for the lighting may also be provided. In particular. The node element (12) may have a structure similar to the node element disclosed in the cited patent, but un this case the hooks for connection with the bracing elements (8, 9 and 10) must be oriented along the angled planes that define the stalls (17). In addition, some of the node elements (12) will not be connected with secondary beams (14). On the other hand, the main beams (13) will include proper holes at fixed points (in the case shown, either at half length or at ¼ and ¾ of their length) in order to allow the connection with the secondary beams (14) by means of brackets and nuts and bolts.

From the foregoing description it appears that the demountable modular structure proposed according to the invention allows to obtain all the advantages of cheap and simple setup of the known structures of this kind with, in addition, the possibility of allowing the angled parking, which is more comfortable for the users, and the possibility to be employed also in case of standard dimensions of the vehicles greater than those currently accepted in Europe, practically with the same number of obtainable parking places in a given available area.

The present invention has been disclosed with particular reference to some specific embodiments thereof, but it should be understood that modifications and changes may be made by the persons skilled in the art without departing from the scope of the invention as defined in the appended claims.

The invention claimed is:

1. A demountable modular structure for parking vehicles on two levels, said demountable modular structure comprising:

two or more parallel structure strips (11) arranged in a longitudinal direction parallel to drive aisles (16) and defining an upper parking level and a lower parking level, each structure strip (11) defined by i) two rows of vertical supporting elements (3), the two rows of vertical supporting elements (3) arranged in a non-orthogonal manner and the first row of the two rows of vertical supporting elements (3) offset from the second row of the two rows of vertical supporting elements (3) in the longitudinal direction with rhomboid parallelogram-shaped ground surface portions formed between two adjacent couples of said vertical supporting elements (3), ii) a plurality of bases (4), wherein a base of the plurality of bases is provided on each of said vertical supporting elements (3), each base configured for resting on the ground free of any foundation, iii) a node element (12) located above each of said plurality of bases (4) and said vertical supporting elements (3), the node element (12) configured for connection with the upper parking level of said structure strip (11), and iv) a plurality of ties (8), the ties (8) having first and second ends, and the ties (8) bracing the demountable modular structure by the first ends of the ties connected to said node elements (12) and the second ends of the ties connected to said plurality of bases (4);

main beams (13) arranged in the longitudinal direction parallel to the drive aisles (16) and resting, through said node elements (12), on said rows of vertical supporting elements (3);

and secondary beams (14) having first and second ends arranged in a direction orthogonal to said longitudinal direction and orthogonal to the drive aisles (16), wherein, i) a first group of the secondary beams rest, through said node elements (12), with a first end on said vertical supporting elements (3) and with the second end at a location free of resting on said vertical supporting elements (3), with no secondary beams (14) resting with both the first end and second end on node elements (12), and ii) a second group of the secondary beams (14) are fixed in orthogonal position to said main beams (13) at locations free of resting on said vertical supports (3), wherein said upper parking level comprises an orthogonal network of the main beams (13) resting, through said node elements (12), on each one of said rows of vertical supporting elements (3), and of the secondary beams (14) resting, through said node elements (12), on said vertical supporting elements (3) or fixed in orthogonal position to said main beams (13), and VI) rectangular floor slabs (15) located on said orthogonal network of the main beams (13) and the secondary beams (14), wherein said demountable modular structure is configured for mounting on the ground at a first location, free of any foundation, and is demountable from the ground for re-use at a second location.

2. The demountable modular structure according to claim 1, wherein the two or more parallel strips (11) comprises three parallel structure strips (11) positioned adjacent to each other as a central structure strip and two lateral structural strips, wherein the central structure strip, at the lower parking level, is used as one of the drive aisles (16) and the two lateral structure strips, at the lower parking level, are provided with angled parking stalls (17), said parallelogram-shaped ground surface portions provided between two adjacent couples of vertical supporting elements (3) making up a couple of adjacent angled parking stalls (17).

3. The demountable modular structure according to claim 2, wherein the offset between the first row of the two rows of vertical supporting elements (3) from the second row of the two rows of vertical supporting elements (3) corresponds to the parking stalls (17) on each side of the drive aisles (16) as the same length but in opposite directions.

4. The demountable modular structure according to claim 3, wherein the rows of vertical supporting elements (3) of said three parallel structure strips (11) are set up so as to define, in plane, two strips of parallelogram-shaped ground surface portions angled in the same direction and another strip angled in the opposite direction, symmetric to an adjacent ground surface portion with respect to a longitudinal axis of said three parallel structure strips.

5. The demountable modular structure according to claim 2, wherein each one of said plurality of bases (4) or each one of said vertical supporting elements (3) incorporates means (5) for adjusting the total length of said vertical supporting element (3).

6. The demountable modular structure according to claim 2, wherein said parallelogram-shaped ground surface portions are angled by 75 to 76 degrees with respect to the longitudinal direction.

7. The demountable modular structure according to claim 2, wherein said lateral structure strips (11) end on the lower parking level with end ground surface portions having a triangular shape (18) or rectangular trapezoid shape (19).

8. The demountable modular structure according to claim 1, wherein each one of said plurality of bases (4) or each one of said vertical supporting elements (3) incorporates means (5) for adjusting the total length of said vertical supporting element (3).

9. The demountable modular structure according to claim 8, wherein each one of said plurality of bases (4) comprises a flat base plate (6) and a hinge system (7) placed between said flat base plate (6) and one of said vertical supporting elements (3).

10. The demountable modular structure according to claim 9, wherein said plurality of ties lay in vertical planes marginal to couples of parking stalls (17), excluding the vertical planes that limit both sides of the drive aisles (16).

11. The demountable modular structure according to claim 9, wherein said means for adjusting the total length of said vertical supporting elements (3) comprise a threaded joint (5) between each one of said plurality of bases (4) and said vertical supporting elements (3).

12. The demountable modular structure according to claim 11, wherein said hinge system (7) comprises a spherical hinge means (7).

13. The demountable modular structure according to claim 12, wherein each one of said spherical hinge means (7) comprises a cylindrical collar rigidly fixed at the center of said flat base plate (6) with an axis orthogonal to the plane of said flat base plate (6), a first hinge member in the shape of a spherical segment resting on said flat base plate (6) within said cylindrical collar with a convex side upwards, a cylindrical pivot (5) externally threaded, of a smaller diameter than said cylindrical collar and having, at a lower end, a second hinge member in the shape of a spherical segment with a concave side downwards, said lower end of said cylindrical pivot (5) being inserted in said cylindrical collar, and an internally threaded sleeve fitting said cylindrical pivot (5) and externally coupled with the lower end of said vertical supporting element (3).

14. The demountable modular structure according to claim 1, wherein said parallelogram-shaped ground surface portions are angled by 75 to 76 degrees with respect to the longitudinal direction.

15. The demountable modular structure according to claim 14, wherein said secondary beams (14) of each one of said parallel structure strips (11) rest on said vertical supporting elements (3) or are fixed to said main beams (13) along said structure strip (11) with a constant pitch, equal to half the distance between two adjacent vertical supporting elements (3) in the direction of the drive aisles (16).

16. The demountable modular structure according to claim 14, wherein said secondary beams (14) of one said structure strips (11) are alternatively resting on said vertical supporting elements (3) and fixed to said main beam (13) at a point corresponding to half a bay on one side of said structure strip, and are fixed to said main beams (13) at points corresponding alternatively to ¼ and ¾ of a bay on the other side of said structure strip.

17. The demountable modular structure according to claim 2, wherein said lateral structure strips (11) end on the lower parking level with end ground surface portions having a triangular shape (18) or rectangular trapezoid shape (19).

18. The demountable modular structure according to claim 17, wherein the parking stalls (17) are adjacent to said end ground surface portions, wherein the end ground surface portions have a rectangular trapezoid shape (19) usable as parking stalls for disabled people.

19. The demountable modular structure according to claim 1, comprising one or more ramps (2) for entering the upper parking level.

20. The demountable modular structure according to claim 19, comprising at least one entrance ramp (2) to the upper parking level and at least one exit ramp (2) from the upper parking level.

* * * * *